United States Patent [19]

Cruz

[11] Patent Number: 4,835,034

[45] Date of Patent: May 30, 1989

[54] INSULATION BOARD AND COMPOSITE SHEET

[76] Inventor: Francisco A. Cruz, 35 Booth St., Annadale, Sydney, Australia, 2038

[21] Appl. No.: 216,193

[22] Filed: Jul. 7, 1988

[30] Foreign Application Priority Data

Jul. 6, 1987 [AU] Australia ..... P12941

[51] Int. Cl.[4] ..... B32B 3/10; B32B 7/04

[52] U.S. Cl. ..... 428/131; 428/139; 428/140; 428/167

[58] Field of Search ..... 428/131, 137, 139, 140, 428/141, 167

[56] References Cited

U.S. PATENT DOCUMENTS 3,712,846 1/1973 Daniels et al. ..... 428/141

4,039,706 8/1977 Tajima et al. ..... 428/131

4,599,258 7/1986 Hageman ..... 428/139

*Primary Examiner*—William J. Van Balen

[57] ABSTRACT

An insulating board is formed of a low density insulating material, such as polystyrene foam. The board has perforations therein and deformations on its upper and its lower surfaces. A high density material, such as gypsum or artificial resin fills the perforations and deformations and extends over the upper and the lower surfaces of the board and, if desired, over its edges to form a composite sheet. Sheets of paper, plastic or metal may be fixed to the top and to the bottom of the composite sheet. A method of making the sheet involves bringing the board into contact with the material of higher density and allowing it to set or cure.

20 Claims, 3 Drawing Sheets

INSULATION BOARD AND COMPOSITE SHEET

BACKGROUND OF THE INVENTION

The present invention relates to an insulation board and composite sheet, and more particularly but not exclusively to a composite sheet for lining walls, providing ceilings, roofs, floors and the like in buildings.

Many varied products are used by the building industry to line internal walls and ceilings in buildings, houses and the like. Some of these include gypsum board, fibrous plaster and low density particle boards, as well as construction members sold under the designations Villaboard TM and Masonite TM. Other products which are used by the building industry include internal tiles, external roof tiles, shingles and the like.

However, all the commonly used materials suffer at least one of the following drawbacks: (a) brittleness, (b) inability to withstand high humidity, (c) high weight/area ratio, (d) susceptibility to warpage, and (e) ineffective insulator.

SUMMARY OF THE INVENTION

It is therefore the object of the present invention to overcome or substantially amliorate the above-mention problems.

According to a first embodiment of this invention there is provided an insulating board formed from a low density material having surface deformations comprising a plurality of perforations, the surface deformations further including a plurality of indentations spaced from the perforations, and a plurality of slots or the like coincident with the perforations.

According to a second embodiment of this invention there is provided a composite sheet for use as a lining or building construction member, the composite sheet comprising an insulation board formed from a low density material, and a high density material applied to at least one side of the insulating board, and the insulation board has surface deformations, comprising a plurality of perforations, the surface deformations further including on the at least one side a plurality of depressions or slots, the perforations and depressions and/or slots being filled by the high density material.

According to a third embodiment of this invention there is provided a process for producing the composite sheet of the second embodiment comprising applying high density material to at least one side of the insulation board of the first embodiment and filling the perforations in the insulation board with the high density material.

Preferred forms of the present invention are described herein below by way of example with reference to the accompanying drawings.

DETAILED DESCRIPTION OF THE PREFERRED EMBODIMENTS

Figure 1:
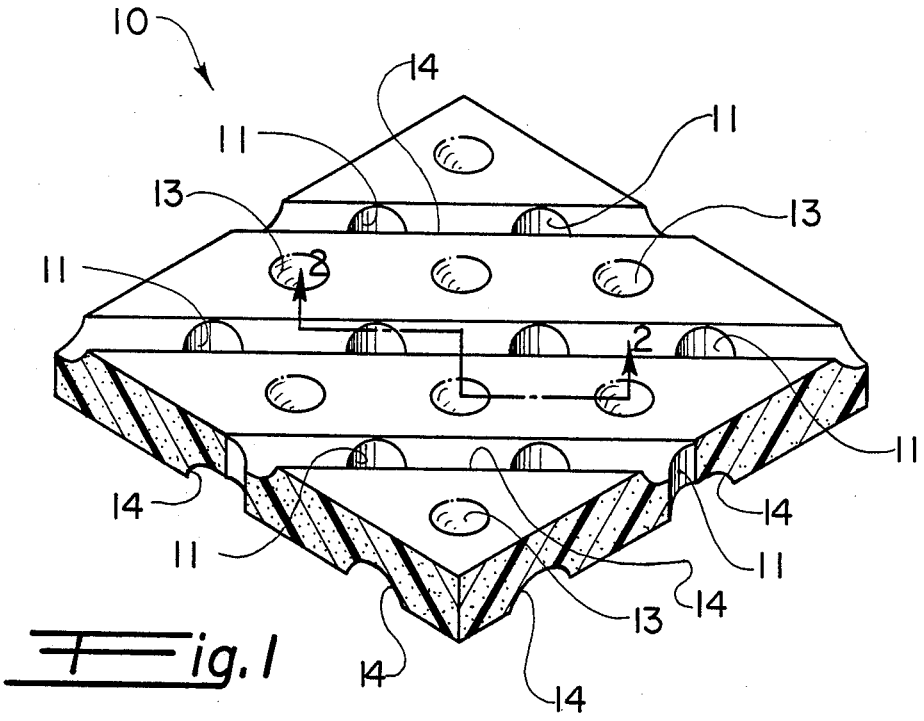
FIG. 1 is a perspective view of a formed low density insulation board constructed in accordance with the present invention.

In FIG. 1 of the accompanying drawings there is schematically depicted a formed low density insulation board 10, preferably made of polysterene foam. The board 10 is provided with a plurality of surface deformations including a plurality of perforations 11 arranged in an array. The perforations 11 are preferably bored through the board 10, but could be formed using any number of coventional techniques. In the preferred embodiment shown in FIG. 1, the surface deformations further include a plurality of semispherical indentations 13 on the upper and lower surfaces of the board 10 between the perforations 11 and a plurality of parallel slots 14 coincident with the rows and/or columns of the array of perforations 11. In the lower surface of the board 10, a second plurality of parallel slots 14 is provided, these slots also being coincident with the rows and/or columns of the array of perforations 11. The slots 14 in the upper surface of the board 10 run perpendicular to those in the bottom surface. The slots 14 are semicircular in cross section.

Figure 2:
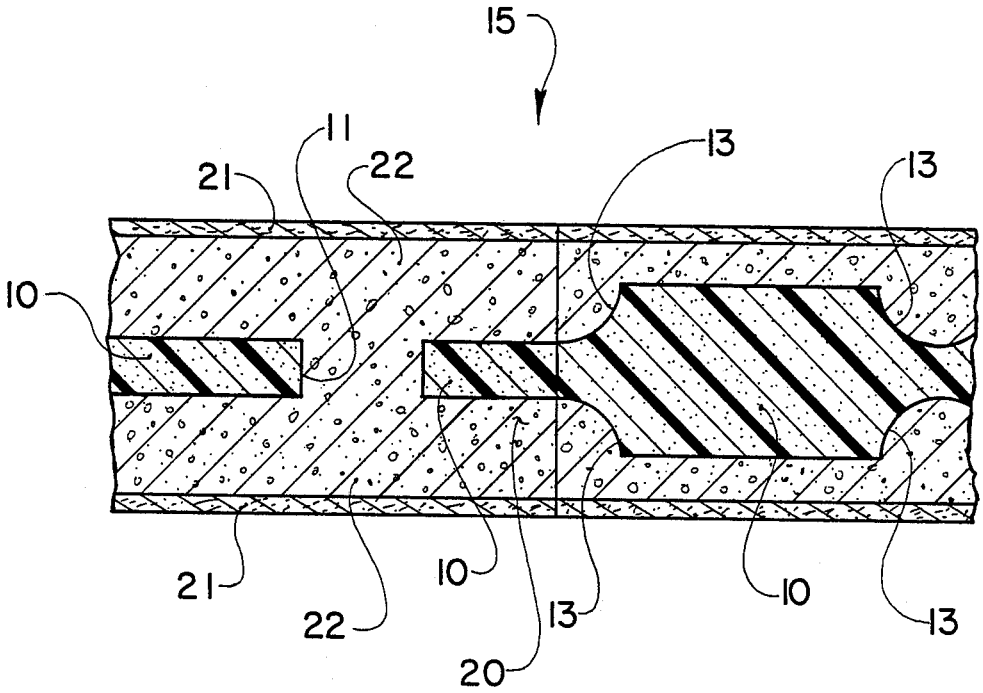
FIG. 2 is a cross sectional view of a portion of a composite sheet incorporating the formed low density insulation board of FIG. 1, the section having been taken through the insulating board of FIG. 1 along section line 2—2.

The board 10 can be used in combination with a material of higher density, such as for example as illustrated in FIG. 2, calcined gypsum 20 (i.e., plaster of Paris), with paper sheets 21 or the like applied to the upper and lower surfaces to provide a composite sheet 15 for lining walls and/or ceilings. Either one or both of the paper sheets 21 could be replaced, if desired, with respective sheets of plastic or metal fixed to the respective upper and lower surfaces of the board 10, were it desired to use the sheet as a tile or the like. It is to be understood that the calcined gypsum 20 could extend along the edges of the board 10, in effect encapsulating the board and providing some protection for the board.

To make the sheet 15, unset calcined gypsum plaster 20 is applied to both the top and bottom surfaces of the board 10. The plaster 20 fills the perforations 11, the indentations 13 and the slots 14. A relatively thin layer of plaster 20 remains adjacent to both the top and bottom surfaces of the board 10. As mentioned above, the plaster 20 may extend along the edges of the board 10, protecting the board and adding additional strength. When dry the board 10 reinforces the plaster 20 and vice versa. The plaster 20 which extends through the perforations 11 provides, in particular, considerable strength against compression forces; the plaster 20 in the slots 14 and in the indentations 13 provide strength and resistance against bending of the sheet 15. The paper sheet 21 or the plastic or metal sheets which may be used in some applications add further strength to the sheet 15.

Further, reinforcing fibres 22, (e.g., fibre glass, hemp, coconut fibres, and the like) can be mixed with unset plaster 20 to further improve the qualities of the board 15.

Figure 3:
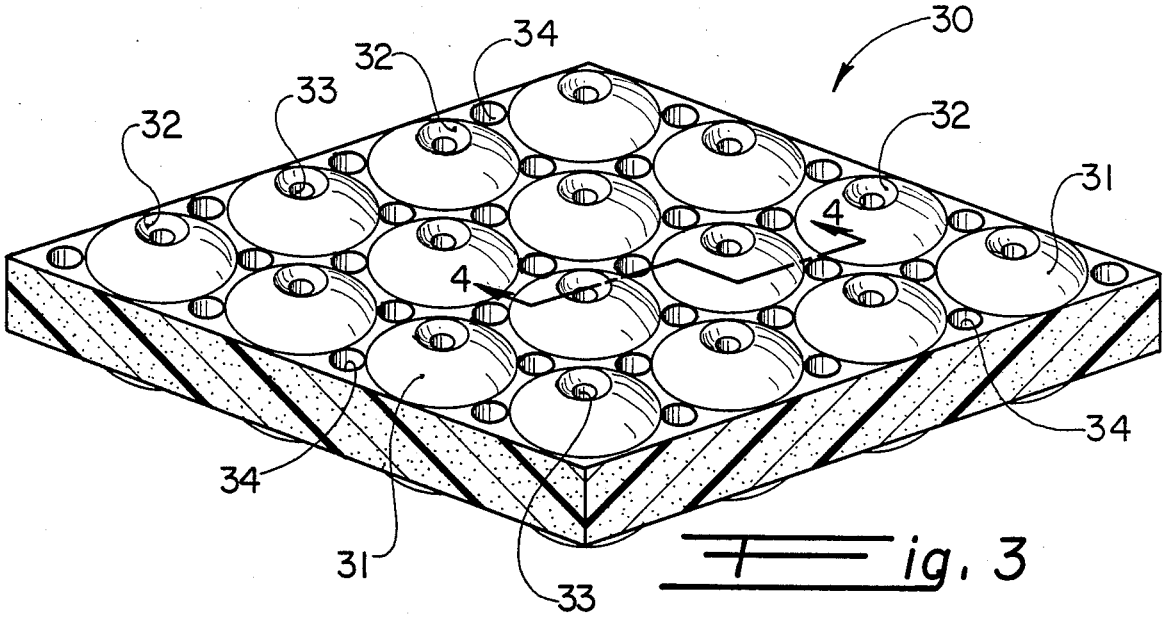
FIG. 3 is a perspective view of a formed low density insulation board constructed in accordance with the present invention, the board being a first variant of the board of FIG. 1.

In FIG. 3 of the accompanying drawings there is schematically depicted a formed low density insulation board 30, preferably made of polysterene foam or the like. The board 30 is provided with a plurality of surface deformations, including a plurality of perforations 34 arranged in a pattern. The perforations 34 are preferably bored through the board 30, but could be formed using any number of conventional techniques. In the preferred variant shown in FIG. 3, the surface deformations further include a plurality of semispherical formations 31 arranged in respective arrays on the top and bottom of the board 30 between the perforations 34, defining interconnected flat areas at the bases of the formations 31. The flat areas are coincident with the perforations 34. Respective apertures 33 extend from the apexes of respective semispherical formations 31 on the upper surface of the board 30 to respective corresponding apexs of semispherical formations 31 on the lower surface of the board. The purpose of the apertures 33, which may be of lesser diameter than the perforations 34, is to allow air to escape from beneath the board 30 during formation of the composite sheet shown in FIG. 4. Respective semispherical depressions 32 are provided at the apexes of the formations 31 coaxial to the apertures 33, the depressions 32 providing a funnel-like configuration which aids in allowing the high density material, such as the gypsum 35 to enter and fill the apertures.

Figure 4:
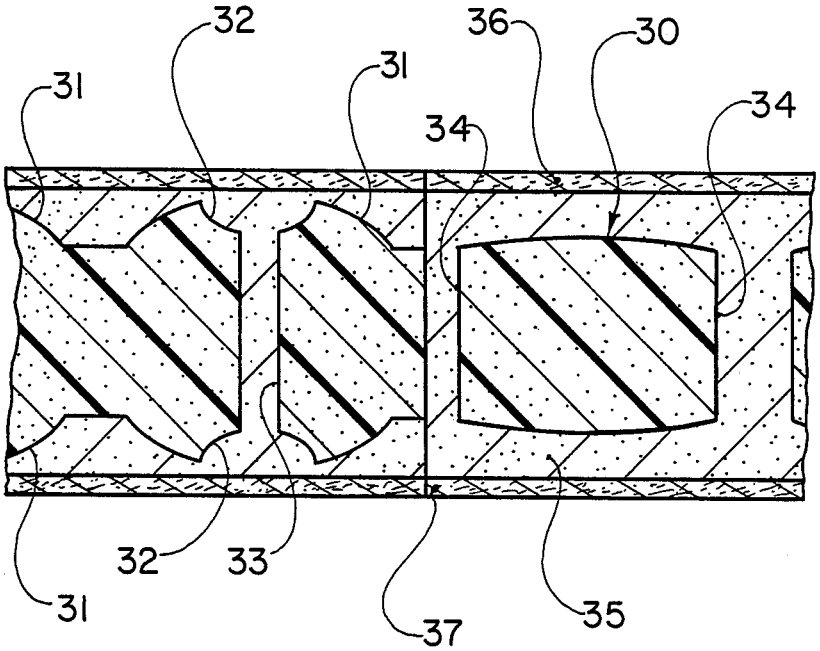
FIG. 4 is a cross sectional view of a portion of a composite sheet incorporating the formed low density insulation board of FIG. 3, the section having been taken through the insulating board of FIG. 3 along section line 4—4.

The board 30 can be used in combination with a material of higher density, such as for example as illustrated in FIG. 4, calcined gypsum 35 (i.e., plaster of Paris), with respective paper sheets 36 and 37 or the like applied to the upper and lower surfaces of provide a composite sheet for lining walls and/or ceilings. Either one or both of the paper sheets 36 and 37 could be replaced, if desired, with respective sheets of plastic or metal fixed the respective top or bottom of the composite sheet, were it desired to use the sheet as a tile or the like. It is to be understood that the calcined gypsum 35 could extend along the edges of the board 30 encapsulating and providing some protection for the board.

To make the comosite sheet illustrated in FIG. 4, unset calcined gypsum plaster 35 is applied to both the top and bottom surfaces of the board 30. The plaster 35 fills the perforations 34, the apertures 33, the depressions 32 and the spaces between the formations 31. A relatively thin layer of plaster 35 remains adjacent to both the top and bottom surface of the board 30. As mentioned above, the plaster 35 may extend along the edges of the board 30, protecting the board and adding additional strength. When dry the board 30 reinforces the plaster 35 and vice versa. The plaster 35 in the flat areas between the formations 31 provide strength and resistance against bending of the composite sheet.

Further, reinforcing fibres, (e.g., fibre glass, hemp, coconut fibres, and the like can be mixed with unset plaster 35, as in the sheet illustrated in FIG. 2, to further improve the qualities of the composite board of FIG. 4.

Figure 5:
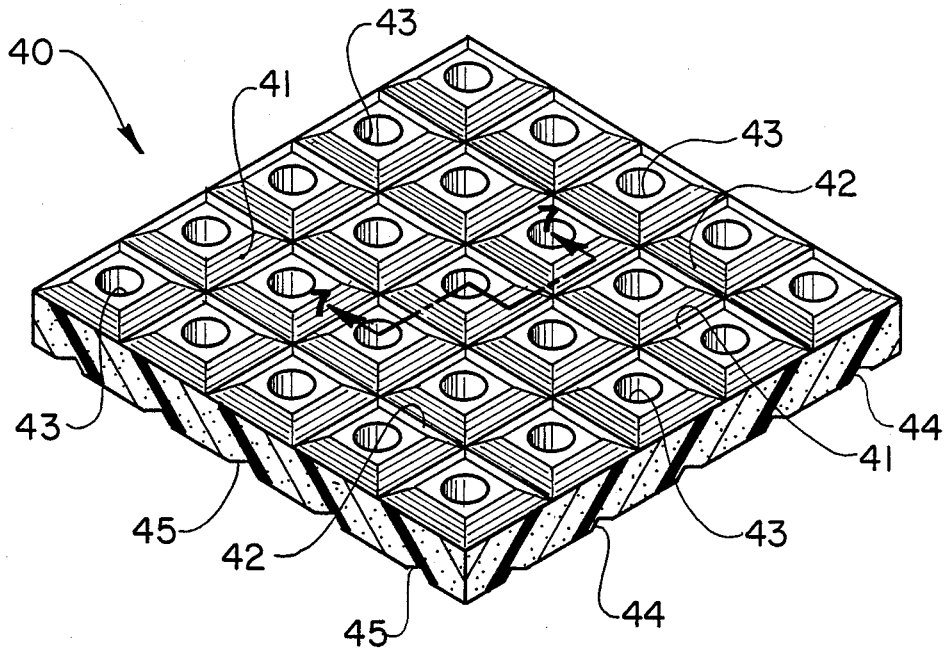
FIG. 5 is a perspective view of a formed low density insulation board constructed in accordance with the present invention, the board being a second variant of the board of FIG. 1.

In FIG. 5 to the accompanying drawings there is schematically depicted a formed low density insulation board 40, preferably made of polysterene foam. The board 40 is provided with a plurality of surface deformations including a plurality of perforations 43 arranged in an array. The perforations 43 are preferably bored through the board 40, but could be formed using any number of conventional techniques. In the preferred variant shown in FIG. 5 the surface deformations further include a plurality of spaced-apart parallel slots 41, of triangular cross section, in the upper surface of the board 40 between rows of the perforations 43 and a second plurality of spaced-apart parallel slots 42 between columns of the perforations 43. The slots 42 run perpendicular to the slots 41 and, like the slots 41, are of triangular cross section. In the lower surface of the board 40, a third plurality of spaced-apart parallel slots 44 and a fourth plurality of spaced-apart slots 45 are provided, these pluralities of slots being respectively coincident with the rows and columns of the array of perforations 43. The slots 44 and 45 are of triangular cross section.

Figure 6:
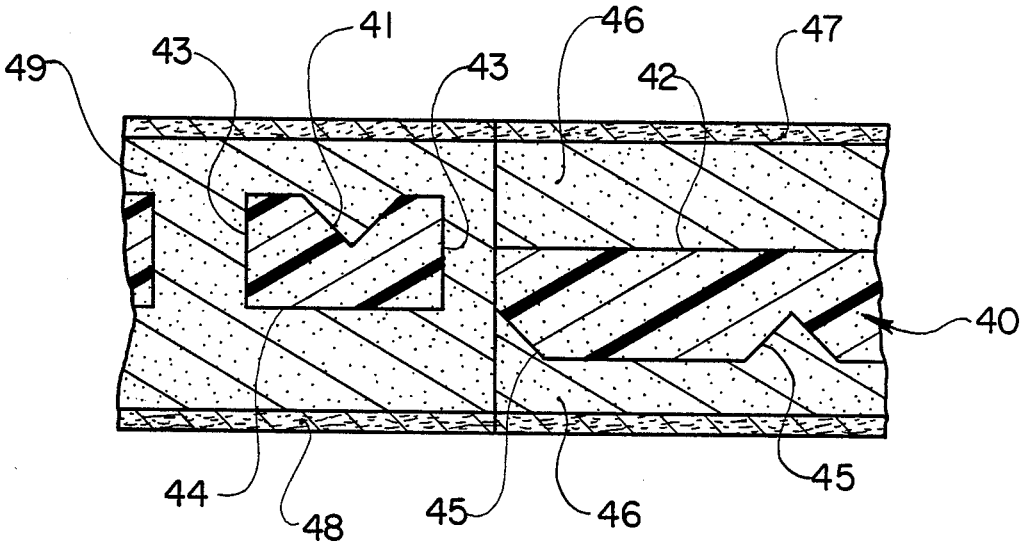
FIG. 6 is a cross sectional view of a portion of a composite sheet incorporating the formed low density insulation board of FIG. 5, the section having been taken through the insulating board of FIG. 5 along section line 6—6.

The board 40 can be used in combination with a material of higher density, such as for example as illustrated in FIG. 6, calcined gypsum 46 (i.e., plaster of Paris), with respective paper sheets 47 and 48 or the like applied to the upper and lower surfaces to provide a composite sheet for lining walls and/or ceilings. Either one or both of the paper sheets 47 and 48 could be replaced, if desired, with respective sheets of plastic or metal fixed to the upper and lower surfaces of the composite sheet, were it desired to use the sheet as a tile, shingle or the like. It is to be understood that the calcined gypsum 46 could extend along the edges of the board 40, providing some protection for the board and encapsulating it.

To make the sheet illustrated in FIG. 6, unset calcined gypsum plaster 46 is applied to both the upper and lower surface of the board 40. The plaster 46 fills the perforations 43, the slots 41, 42, 44 and 45. A relatively thin layer of plaster 46 remains adjacent to both the upper and lower surfaces of the board 40. As mentioned above, the plaster 46 may extend along the edges of the board 40, protecting the board and adding additional strength. The plaster 46 which extends through the perforations 43 provides, in particular, considerable strength against compression forces; the plaster 46 in the slots 41,42,44 and 45 provide strength and resistance to bending and twisting forces. The paper sheets 47 and 48 or the plastic or metal sheets which may be used in some applications add further strength to the composite sheet of FIG. 6.

As in the cases of FIGS. 2 and 4, reinforcing fibres, (e.g. fibre glass, hemp, coconut fibres, and like) can be mixed with the unset plaster 46 to further improve the qualities of the board in the same manner as the fibres 22 reinforce the composite sheet 15 (FIG. 2).

The composite sheet 15 of FIG. 2, as well as those shown in FIGS. 4 and 6, is a sheet of lighter construction than present commonly used materials, and can be of equal, or greater strength. It is durable, and less likely to sag or warp in use. The polysterene insulation board 10 of FIG. 1, as well as those illustrated in FIGS. 3 and 5, provides the composite sheets, in each case, with a relatively low coefficient of heat transfer (i.e., the plaster board has good insulative properties) and a high resistance to moisture absorption.

A composite sheet has been described wherein a polystyrene insulation board is incorporated in plaster material. However, the polystyrene insulation board can also be used in combination with a wide variety of other materials such as fast setting cement compositions to produce different types of composite sheets. For example, hydraulic cements such as: Portland cement, cements possessing qualities such as rapid hardening, low heat transfer, sulphate reisting (i.e. qualities due to additives); cement mixtures such as masonite cement, lime cements, selenitic cement, Pozzolanic cement, calcium sulphate cements; and cement with silica fillers; may be used in combination with the polystyrene (or other low density material) insulation boards. Moreover, a number of materials other than cements could be used. For example, a number of artificial resins (relatively high density plastics) could be used in place of the plaster, such material in liquid form could be poured over the board, while it is held in a fixed position and allowed to cover the upper and lower surfaces of the board 10, as well as its edges if desired. The artificial resin then would be allowed to set or cure in place, encapsulating the board illustrated in FIGS. 1, 3 or 5, as the cases may be. This combination is very suitable for forming floor and/or roof tiles and the like.

Due to its lightness and strength, a composite sheet according to the present invention has a wide range of applications. Thus apart from use in or as ceilings, wall panels, partitions etc., a composite sheet of the invention can be used as a flooring underlay, wall and ceiling insulation, artistic casting or pre-form support, an interior or exterior tile, or roofing member, depending on the selection of materials. Moreover, the shape of the board and resulting sheet could be chosen so that a plurality of the sheets could be interlocked and/or positioned adjacent to others of the same shape to provide a pleasing appearance and provide a modular approach to laying a floor, lining a wall or ceiling and roofing a building.

What is claimed is:

1. An article comprising an insulating board having a plurality of perforations therein arranged in an array, said board being formed from a low density material and having an upper surface and a lower surface, at least one of said surfaces having surface deformations, said deformations including indentations spaced from said perforations and a plurality of areas of reduced thickness, at least some of which are coincident with said perforations.

2. The article of claim 1, wherein said areas of reduced thickness comprises a plurality of spaced-apart slots in at least one of said upper surface and said lower surface.

3. The article of claim 2, wherein said plurality of spaced-apart slots comprises a first plurality of slots in said upper surface and a second plurality of slots in said lower surface.

4. The article of claim 3, wherein said first plurality of spaced-apart slots and said second plurality of spaced-apart slots are perpendicular to one another.

5. The article of claim 2, wherein said plurality of spaced-apart slots comprise a first plurality of slots in said lower surface and a second plurality of slots in said lower surface, said first and said second pluralities of slots running perpendicular to one another and being coincident with rows and columns of said array of perforations.

6. The article of claim 5, wherein said plurality of spaced-apart slots further include a third plurality of slots in said upper surface and a fourth plurality of slots in said upper surface, said third and said fourth pluralities of slots being spaced from the perforations and being perpendicular to one another.

7. The article according to claim 1, including a plurality of semispherical formations arranged in an array on the upper surface and defining interconnected flat areas therebetween, said perforations being in said flat areas.

8. The article according to claim 7, including respective apertures extending through the board from respective apexes of said formations.

9. The article according to claim 8, including respective depressions coaxial to said apertures.

10. The article according to claim 1, wherein said low density material is polysterene foam.

11. A composite sheet comprising an insulating board having a plurality of perforations therein arranged in a array, said board being formed of low density material and having an upper surface and a lower surface, at least one of said surfaces having surface deformations, said deformations including indentations spaced from said perforations and a plurality of areas of reduced thickness, at least some of which are coincident with said perforations; and a material of higher density than the density of the board applied to at least one of said upper surface and said lower surface and extending through said perforations and filling said deformations.

12. The composite sheet of claim 11, wherein said material of said higher density is also applied to both said upper surface and said lower surface.

13. The composite sheet of claim 12, wherein said material of higher density is also applied to edges of said board encapsulating same.

14. The composite sheet of claim 11, wherein said area of reduced thickness comprise spaced-apart slots, said slots being filled with said material of higher density.

15. The composite sheet of claim 14, wherein said slots are in both the upper surface of said board and said lower surface of said board.

16. The composite sheet of claim 11, wherein said areas of reduced thickness are defined by substantially flat areas, semispherical formations extending from at least one of said upper surface and said lower surface, said material of higher density covering said flat areas and said formations, and wherein said perforations open into said substantially flat areas.

17. The composite sheet of claim 11, wherein said material of higher density is gypsum.

18. The composite sheet of claim 11, wherein said material of higher density is an artificial resin.

19. The composite sheet of claim 11, including a sheet of material fixed to at least one of top and bottom of the composite sheet.

20. A method of producing a composite sheet comprising providing an insulating board of low density material having perforations therein and surface deformations in at least one of its upper surface and its lower surface; and filling the perforations and the deformations with a material having a greater density than said low density material so as to cover at least one of said upper surface and said lower surface.

* * * * *